US008819883B2

(12) United States Patent
Laing et al.

(10) Patent No.: US 8,819,883 B2
(45) Date of Patent: Sep. 2, 2014

(54) GOLF CLUB CLEANING DEVICE

(75) Inventors: Phillip Roy Laing, Western Australia (AU); Roberto Angelo Monzu, Western Australia (AU); Edward Joseph Khoury, Western Australia (AU)

(73) Assignee: LM Golf Australia Pty Ltd., Western Australia (AU)

( * ) Notice: Subject to any disclaimer, the term of this patent is extended or adjusted under 35 U.S.C. 154(b) by 0 days.

(21) Appl. No.: 14/122,321

(22) PCT Filed: May 28, 2012

(86) PCT No.: PCT/AU2012/000592

§ 371 (c)(1), (2), (4) Date: Feb. 20, 2014

(87) PCT Pub. No.: WO2012/162730

PCT Pub. Date: Dec. 6, 2012

(65) Prior Publication Data

US 2014/0150192 A1 Jun. 5, 2014

(30) Foreign Application Priority Data

May 31, 2011 (AU) ..... 2011902120
Jul. 1, 2011 (AU) ..... 2011902609

(51) Int. Cl.
*A46B 15/00* (2006.01)
*A63B 57/00* (2006.01)

(52) U.S. Cl.
CPC ..... *A63B 57/0087* (2013.01)
USPC ..... 15/160; 15/246

(58) Field of Classification Search
USPC ..... 15/160, 161, 246
See application file for complete search history.

(56) References Cited

U.S. PATENT DOCUMENTS

| | | | | |
|---|---|---|---|---|
| 3,747,150 | A | 7/1973 | Kozub | |
| 8,413,287 | B2 * | 4/2013 | Arledge | 15/160 |
| 8,635,733 | B2 * | 1/2014 | Bardzilowski | 15/160 |
| 8,707,502 | B2 * | 4/2014 | Arledge et al. | 15/160 |
| 2011/0099736 | A1 | 5/2011 | Arledge | |

OTHER PUBLICATIONS

International Search report dated Jun. 18, 2012.

* cited by examiner

*Primary Examiner* — Randall Chin
(74) *Attorney, Agent, or Firm* — Bachman & LaPointe, P.C.

(57) ABSTRACT

A golf club cleaning device (10) includes a base member (12) and a brush member (14) secured to the base member (12). The brush member (14) includes bristles arranged around a circular outer edge thereof. One or more straps (26) are provided having hooks (28) at first ends thereof and second ends secured to the base member (12). The hooks (28) engage with a peripheral edge of a rim (18) of the wheel (16) to secure the base member (12) to a side surface of a wheel (16) such that while the wheel (16) is turning, the brush member (14) and the base member (12) rotate so that a face of a golf club (44) can be cleaned by the rotating bristles (39).

15 Claims, 14 Drawing Sheets

DETAIL B

DETAIL C

SECTION A-A

GOLF CLUB CLEANING DEVICE

FIELD OF THE INVENTION

The present invention relates to a device for cleaning the heads of golf clubs.

BACKGROUND TO THE INVENTION

When playing golf it is common for the head of the golf club to contact the ground during a shot. This can result in debris such as soil or grass becoming lodged on the face of the club. As such debris on the face of the club can affect subsequent shots, it is usual for golfers to clean the head of the golf club between shots.

The most common method of cleaning a golf club is to simply carry a suitable rag or towel and use it to wipe the face. This process can be messy as it requires holding the head of the club upwards adjacent the body where dirt can fall onto clothing or shoes. It also requires two hands to both hold the club and the cleaning towel. Other devices have been proposed for cleaning golf clubs but many of these suffer from similar disadvantages.

Modifications have been proposed to the wheels of golf buggies in order to provide a bristled surface on the wheel. The bristles rotate as the wheel turns and these rotating bristles can be used to clean the golf club face. These devices however require that the wheel of the buggy be of a particular construction. The present invention relates to a device for cleaning golf clubs aimed at providing both effective cleaning of golf clubs with easy attachment to a range of different buggy wheels of various sizes and configurations.

SUMMARY OF THE INVENTION

According to one aspect of the present invention there is provided a golf club cleaning device comprising:

a base member;

a brush member secured to the base member having bristles arranged around a circular outer edge thereof; and one or more securing members extending from the base member, the securing members comprising straps having hooks at first ends thereof and second ends secured to the base member;

wherein the hooks engage with a peripheral edge of a rim of the wheel to secure the base member to a side surface of a wheel such that while the wheel is turning, the brush member and the base member rotate so that a face of a golf club can be cleaned by the rotating bristles.

Preferably the straps are length adjustable relative to the base member such that the hooks can be engaged with the rim and then the straps shortened to tighten the straps and secure the base member firmly relative to the rim.

Preferably the base member comprises:

a base portion arranged such that a first side surface thereof is adjacent the rim of the wheel; and a cover securable to a second opposite side surface of the base portion; wherein second ends of the strap are received between the base portion and the cover.

In a preferred embodiment, the second ends of the straps are received in slots in the second side surface of the base portion.

In one embodiment, flexible tabs are provided on lower surfaces of the slots and teeth are provided on a side of each of the straps such that tabs engage with the teeth to prevent outward movement of the straps relative to the base member but allow inward movement of the straps relative to the base member.

Each of the slots is preferably provided at a different depth so that each of the straps can be placed in the slots and pass above or below the other straps.

The straps may include graduations to provide an indication of the amount by which the strap is extended from the base member.

Preferably the straps extend radially outward from the base member at equal angular spacings.

In a preferred embodiment, the base portion is generally cylindrical in shape and the cover comprises is circular and of the same diameter as the base portion.

Preferably the brush member is removably securable to the base member.

In one embodiment, the brush member comprises a central disc portion and an outer rim portion, the outer rim portion being generally annular in shape and including outwardly extending bristles on the surface thereof.

Preferably the brush member includes a pair of spring biased engagement members on opposite sides of the central disc portion being mounted for slidable movement relative to the brush member such that outer edges of the engagement members are engageable with lip portions provided around the periphery of the cover to secure the brush member to the cover.

The engagement members are preferably pushed radially inward against the spring bias and then released when the brush member is in position to move outwardly such that the outer edges thereof engage under the lip portions to secure the brush member.

The hooks are preferably provided with holes for receiving threaded fasteners to provide an alternative method of securing the straps to the rim of the wheel. Spacers may be provided between the hooks and the rim through which the threaded fasteners are received.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1C:
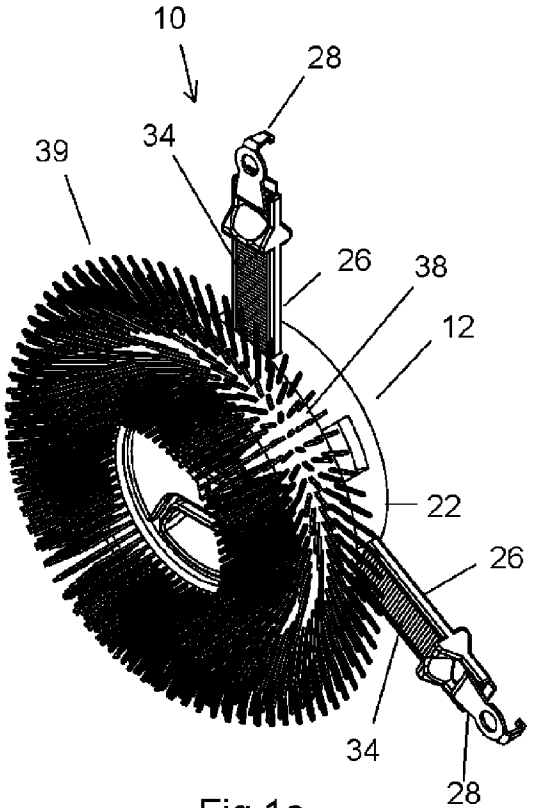
FIG. 1*c* is an upper perspective view of the golf club cleaning device of FIG. 1*a;*
Figure 1B:
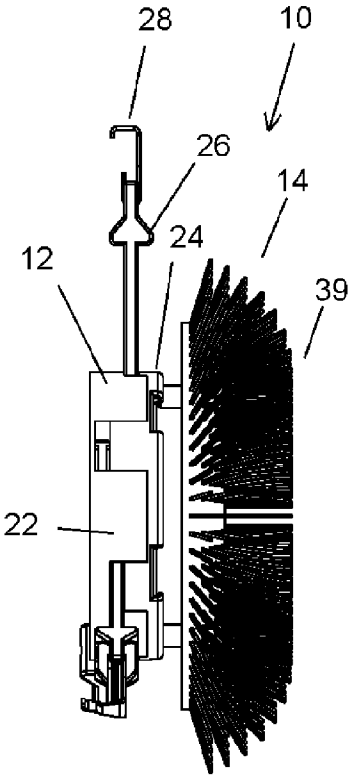
FIG. 1*b* is a side view of the golf club cleaning device of FIG. 1*a;*
Figure 1A:
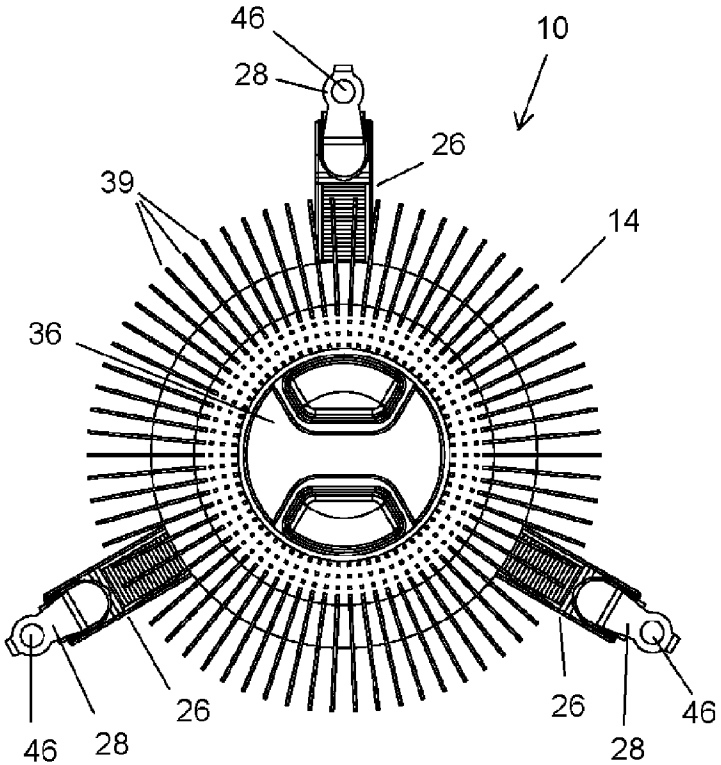
FIG. 1*a* is a front view of a golf club cleaning device in accordance with the present invention.
Figure 2:
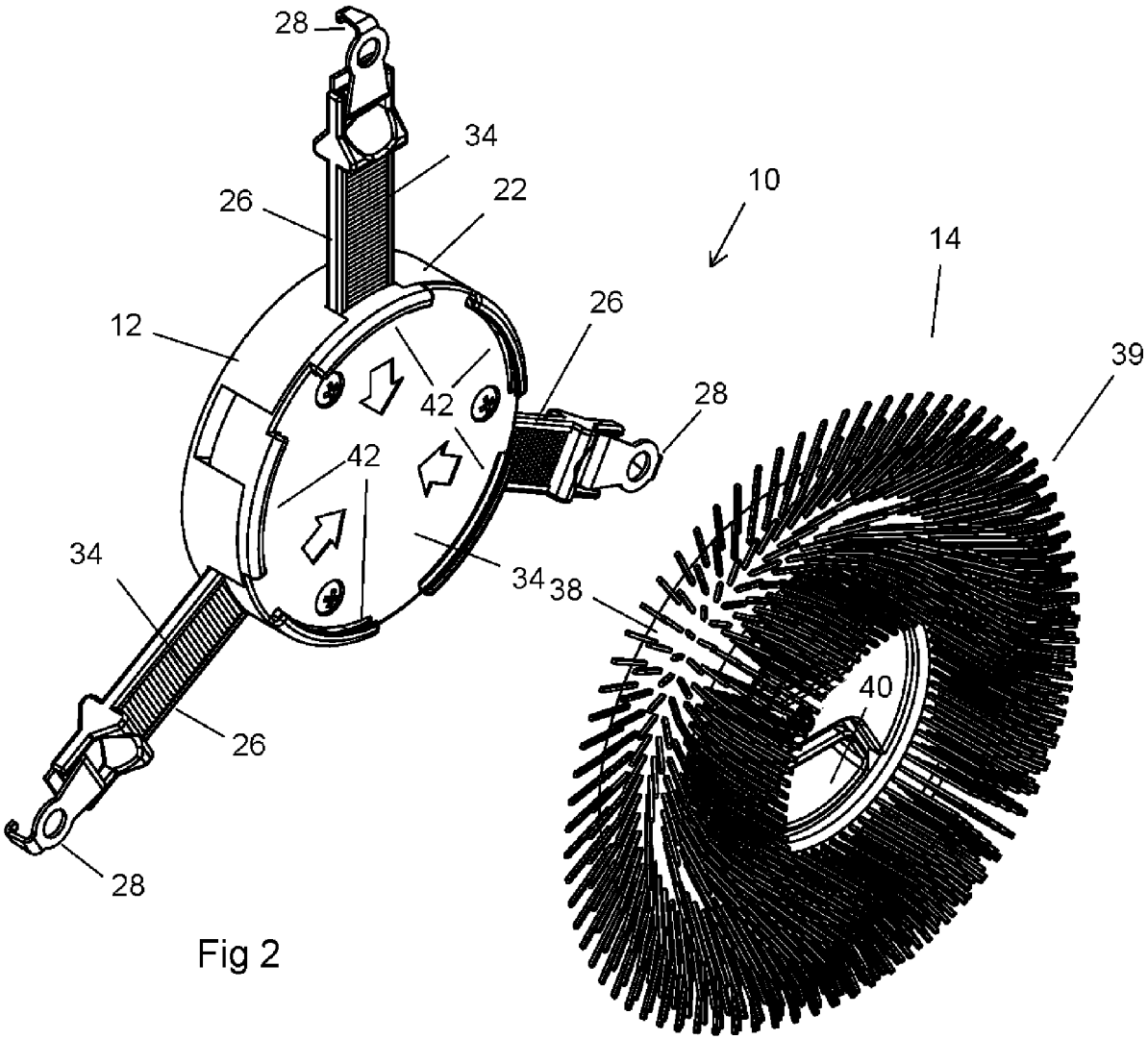
FIG. 2 is an upper perspective view of the golf club cleaning device of FIG. 1 with the brush member removed.
Figure 3C:
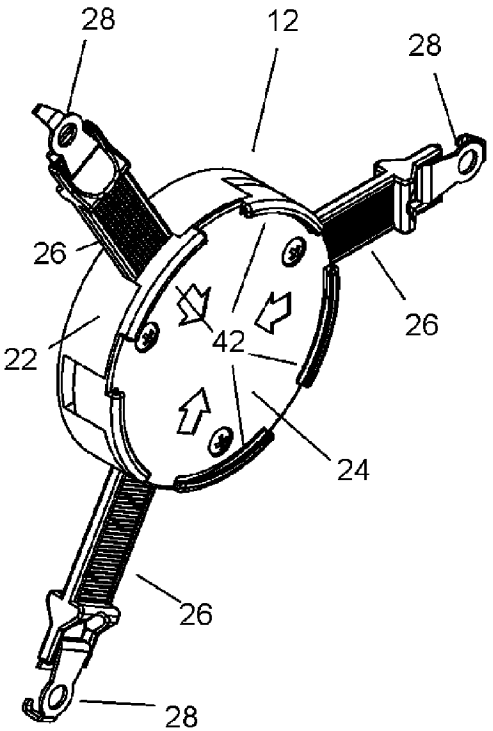
FIG. 3*c* is an upper perspective view of the base member of the golf club cleaning device of FIG. 1.
Figure 3B:
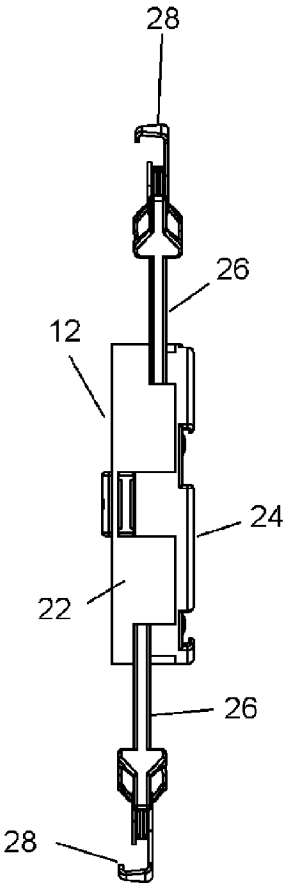
FIG. 3*b* is a side view of the base member of the golf club cleaning device of FIG. 1.
Figure 3A:
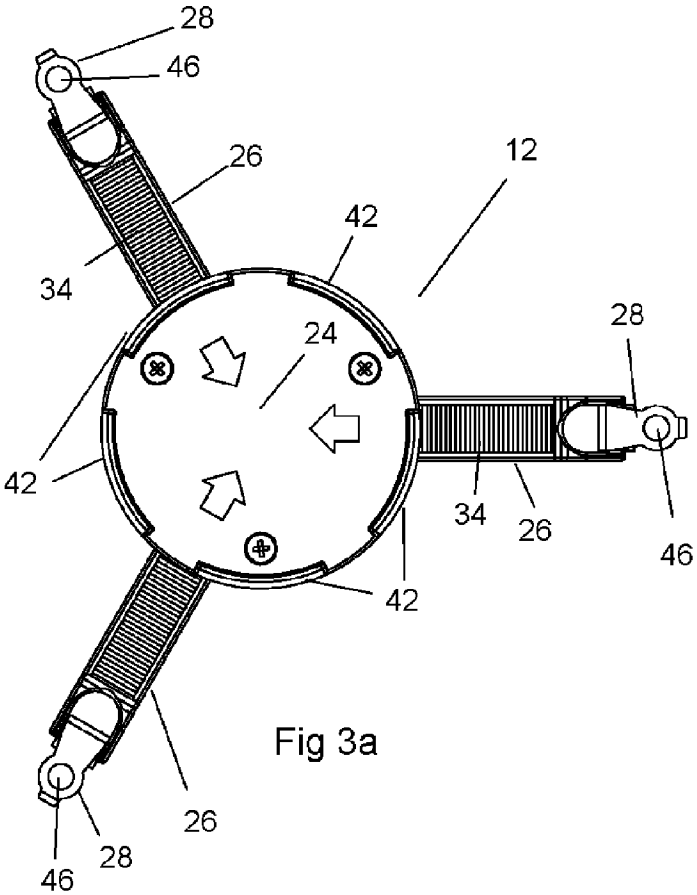
FIG. 3*a* is a front view of the base member of the golf club cleaning device of FIG. 1.
Figure 4:
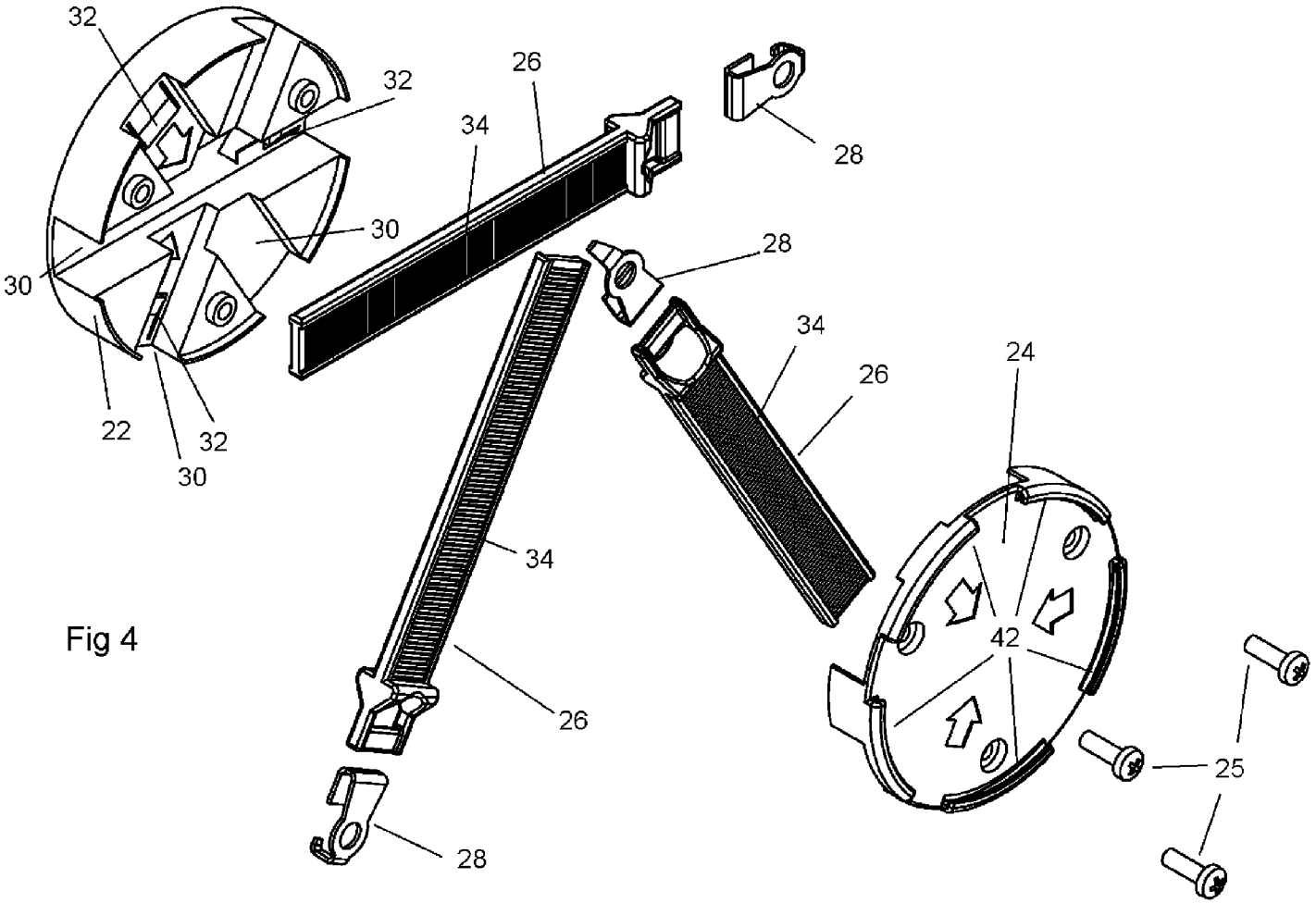
FIG. 4 is an exploded view of the base member.
Figure 5C:
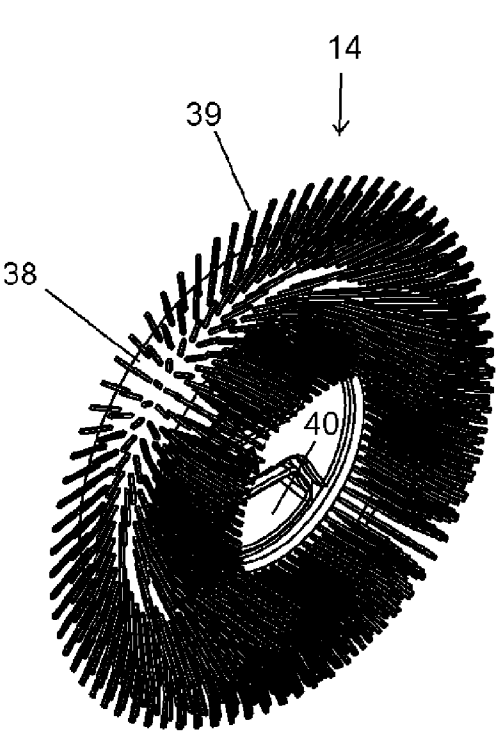
FIG. 5*c* is an upper perspective view of brush member the golf club cleaning device of FIG. 1.
Figure 5B:
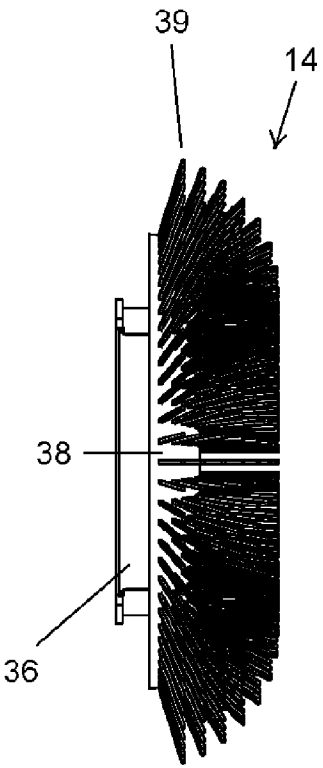
FIG. 5*b* is a side view of the brush member of the golf club cleaning device of FIG. 1.
Figure 5A:
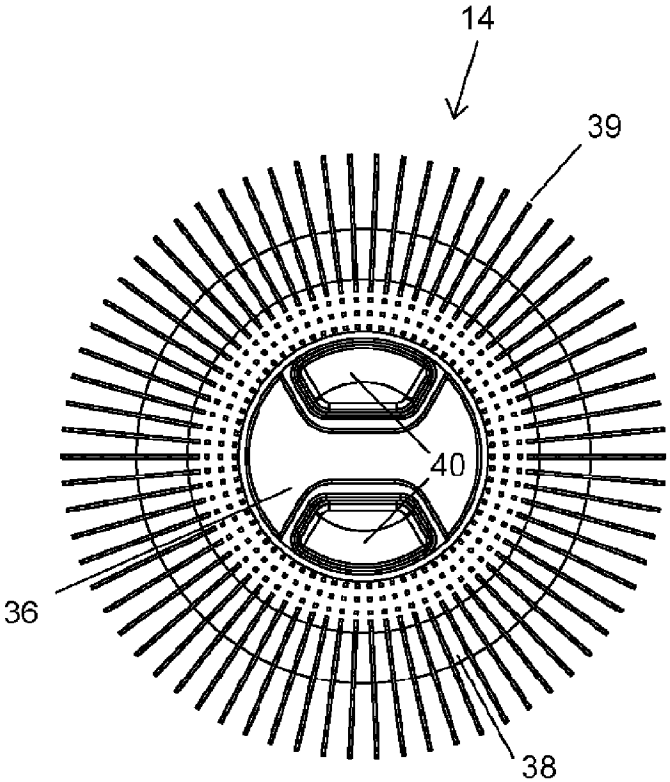
FIG. 5*a* is a front view of the brush member of the golf club cleaning device of FIG. 1.
Figure 6:
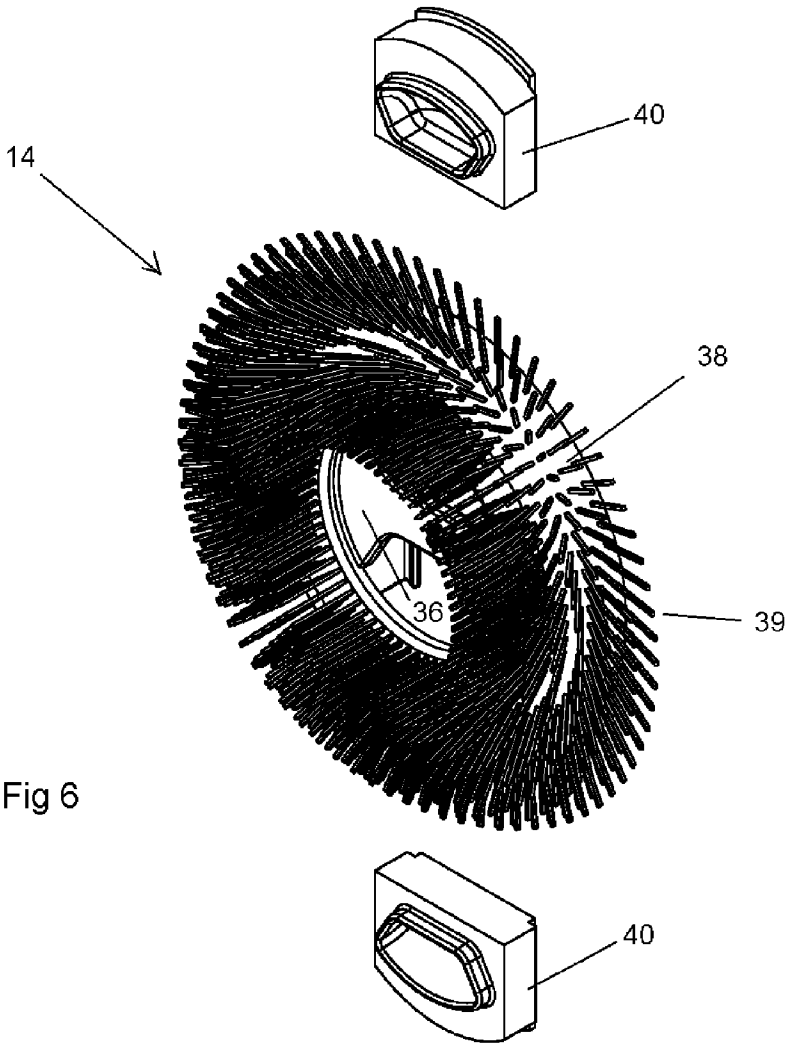
FIG. 6 is an exploded view of the brush member.

Referring to FIGS. 1 to 12, there is provided a golf club cleaning device 10 comprising a base member 12 and a brush member 14. The base member 12 is to be secured to a side surface of a wheel 16 of a golf buggy. The wheel 16 is of a standard construction comprising a rim 18 and a tyre 20.

The base member 12 is arranged to be secured to the rim 18 on the side surface of the wheel 16 by a plurality of securing members. The brush member 14 is securable to the base member 12.

The base member 12 comprises a base portion 22 and cover 24. A first side surface of the base portion 22 is arranged adjacent the rim 18 of the wheel 16 in use and the cover 24 is securable to a second opposite side surface of the base portion 22. In the embodiment shown, the base portion 22 is generally cylindrical in shape and the first and second side surfaces therefore are circular. The cover 24 comprises a circular cover of the same diameter as the base portion 22 securable to the second side surface of the base portion 22. The cover 24 is secured to the second side surface of the base portion 22 by suitable means such as securing screws 25 passing through the cover 24 into corresponding holes in the base portion 22.

The securing members for fixing the base member 12 to the rim 18 comprise straps 26. In the embodiment shown, there are provided three such straps 26. Each of the straps 26 includes a hook 28 secured at a first end thereof. Second ends of the straps 26 are to be secured in use to the base member 12 such that the straps extend radially outward from the base member 12 at equal angular spacings. The hooks 28 are provided to be secured over a peripheral edge of the rim 18. The straps 26 are length adjustable relative to the base member 12 such that the hooks 28 can be engaged with the rim 18 and then the straps 26 shortened to tighten the straps 26 and secure the base member 12 firmly relative to the rim 18.

The second side surface of the base portion 22 includes slots 30 therein for receiving the straps 26. Each of the slots 30 extends across the second side surface of the base portion 22 through the centre thereof. Each of the slots 30 is provided at a different depth so that each of the straps 26 can be placed in the slots 30 and pass above or below the other straps 26.

Each of slots 30 is also provided with a flexible tab 32 on a lower surface thereof. The flexible tab 32 is provided to engage with teeth 34 provided on a side of the corresponding strap 26 along the length thereof. The flexible tab 32 and the teeth 34 are shaped such that the strap 26 can pass over the tab 32 when moved in an inward direction causing the tab 32 to move away from the strap 26. When the strap 26 is moved in an outward direction, the tab 32 engages with adjacent teeth 34 on the strap 26 to prevent movement. That is, the straps 26 can each be moved inwardly towards the base member 12 to tighten the straps 26 but cannot be moved outwardly.

The brush member 14 is securable to the outer surface of the cover 24. The brush member 14 comprises a central disc portion 36 and an outer rim portion 38. The outer rim portion 38 is generally annular in shape and includes outwardly extending bristles 39 on the surface thereof. The annular shape of the outer rim portion 38 results in bristles 39 extending at various angles from generally radially, to a direction generally perpendicular to the plane of the central disc portion 36.

The central disc portion 36 includes a pair of engagement members 40. The engagement members 40 are provided on opposite sides of the central disc portion 36 and are mounted for slidable movement relative to the central disc portion 36 in a radial direction. The engagement members 40 are spring biased to move outwardly relative to the central disc portion 36 of the brush member 14.

Outer edges of the engagement members 40 are provided to engage with lip portions 42 provided around the periphery of the cover 24. The lip portions 42 are provided such that engagement members 40 can be pushed radially inward against the spring bias and then released when the brush member 14 is in position to move outwardly such that the outer edges thereof engage under the lip portions 42 to secure the brush member 14. The brush member 14 can therefore be removed and replaced as required by sliding operation of the engagement members 40. When engaged with the base member 12, the brush member 14 cannot rotate relative to the base member 12.

Figures 7A, 7B, 7C:
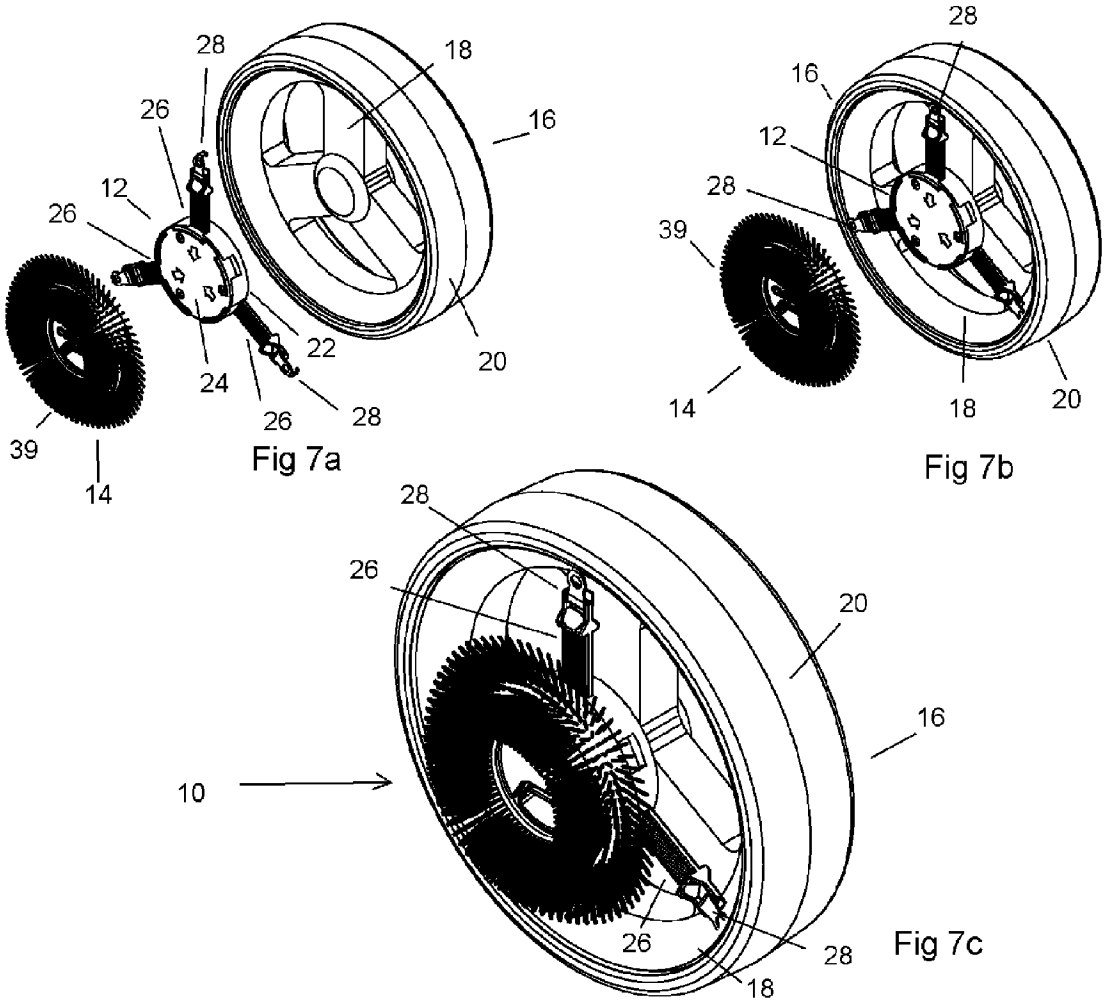
FIG. 7*a* is an upper perspective view showing the base member and the brush member prior to engagement with the wheel of a golf buggy.
FIG. 7*b* is an upper perspective view showing the base member secured to the wheel.
FIG. 7*c* is an upper perspective view showing the brush member secured to the base member.
Figure 8B:
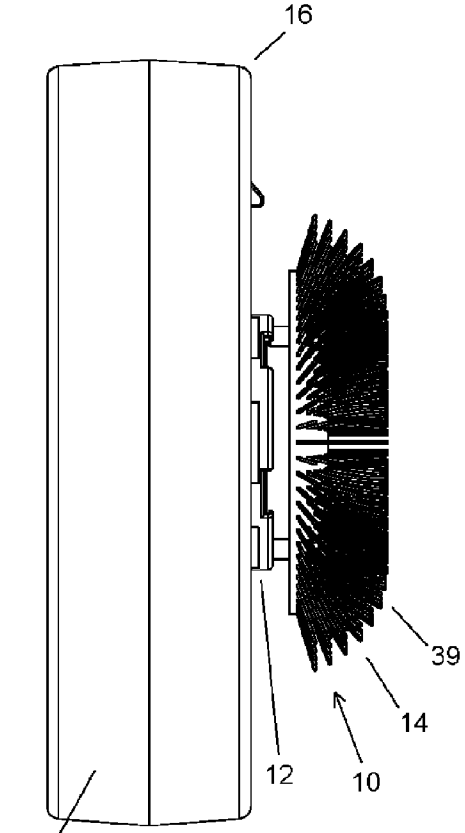
FIG. 8*b* is a side view of the golf club cleaning device secured to the wheel.
Figure 8A:
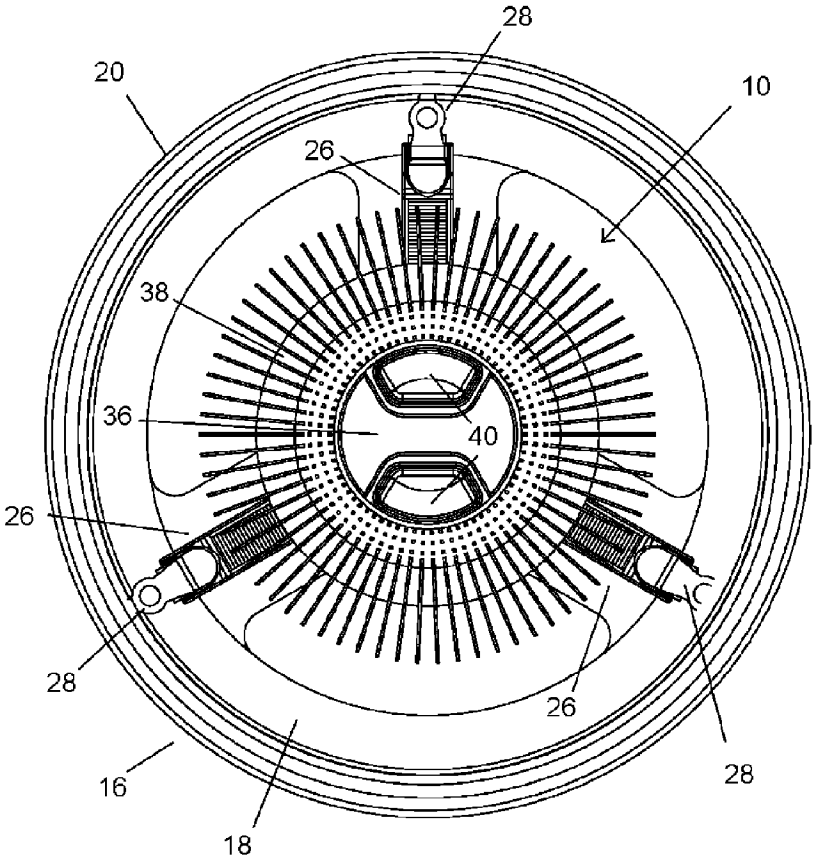
FIG. 8*a* is a front view of the golf club cleaning device secured to the wheel.
Figure 9C:
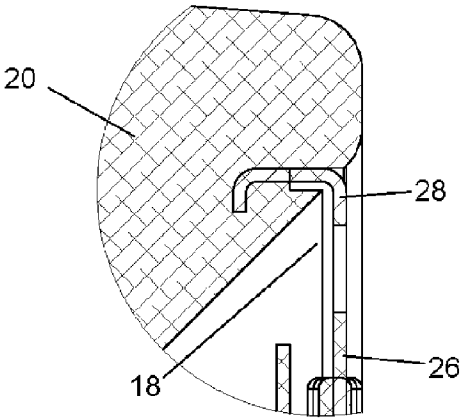
FIG. 9*c* is a close up view of Detail B of FIG. 9*b;*
Figure 9D:
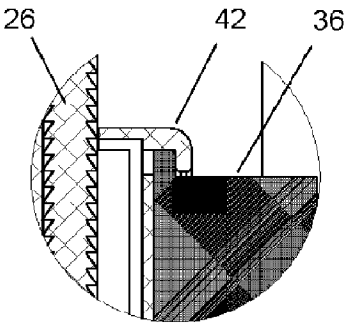
FIG. 9*d* is a close up view of Detail C of FIG. 9*b;*
Figure 9B:
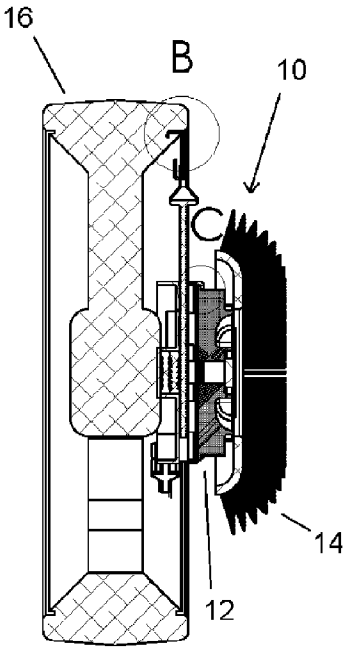
FIG. 9*b* is a side cross sectional view of the golf club cleaning device secured to the wheel through the line A-A.
Figure 9A:
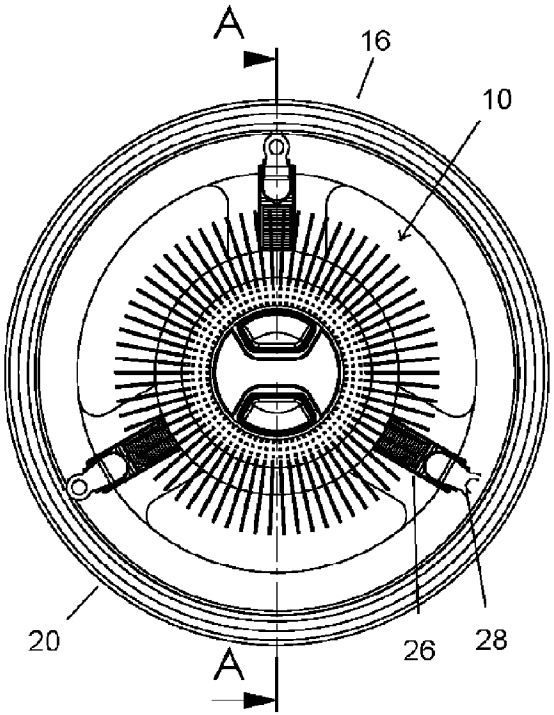
FIG. 9*a* is a front view of the golf club cleaning device secured to the wheel of the golf buggy.

In use, the golf club cleaning device 10 is secured to the rim 18 of the wheel 16 as shown in FIG. 7. The base member 12 is placed centrally adjacent the side surface of the rim 18 and the hooks 28 engaged over the peripheral edge of the rim 18. The straps 26 are then moved inwardly towards the base member 12 to tighten the straps 26 and prevent disengagement of the hooks 28 from the rim 18. The straps 26 are to be tightened equally so that the central axis of the base member 12 is coaxial with the axis of rotation of the wheel 16. If for any reason the base member 12 needs to be removed from the wheel 16, the cover 24 can be removed to disengage the straps 26 from the flexible tabs 32.

Figure 12B:
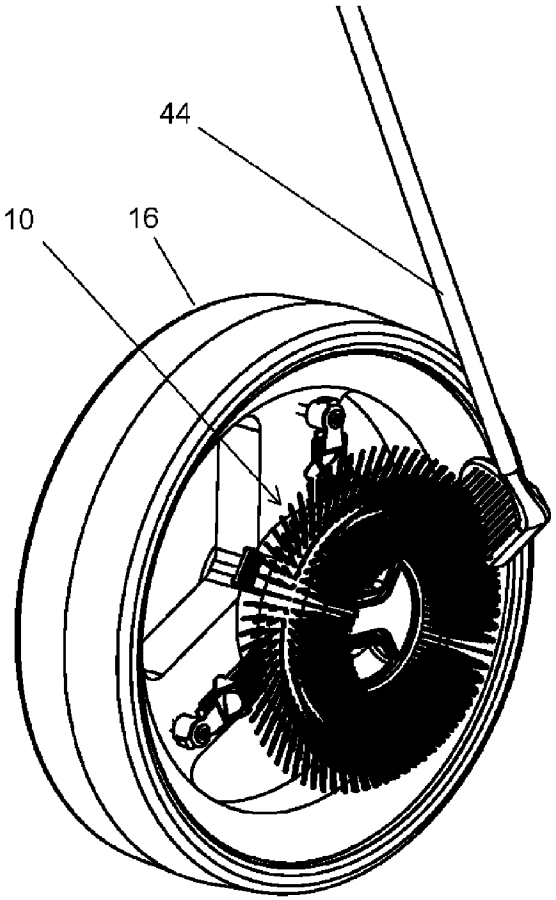
FIG. 12*b* is an upper perspective view showing the face of the golf club being cleaned.
Figure 12A:
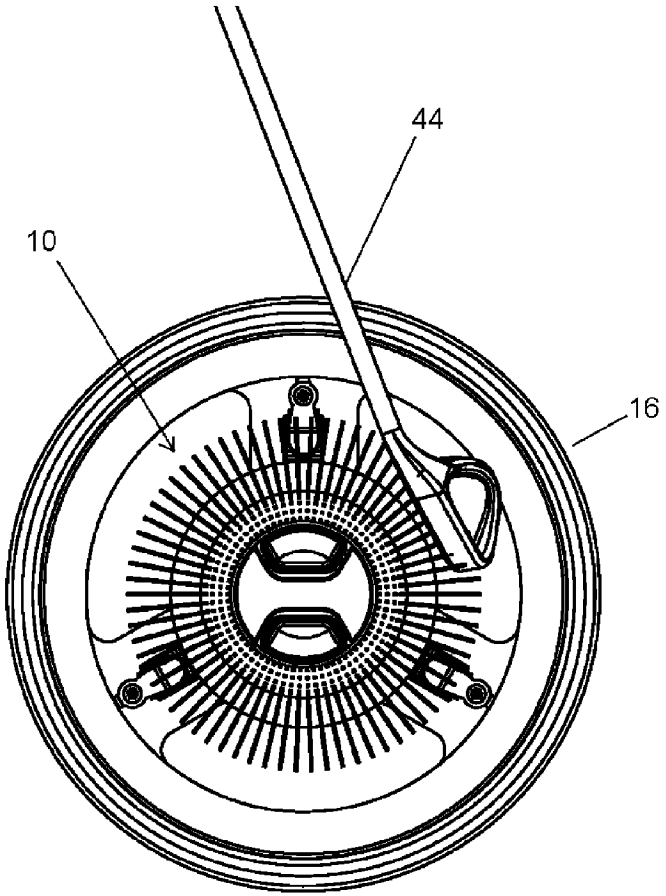
FIG. 12*a* is a front view showing the face of a golf club being cleaned by the golf club cleaning device.

The brush member 14 is then secured to the base member 12 as described previously. In the secured position, any rotation of the wheel 16 causes rotation of the golf club cleaning device 10. The bristles 39 therefore rotate when the wheel is turning, as would be the case when walking with the buggy. A golf club 44 can then be held adjacent the golf club cleaning device 10 as shown in FIG. 12 such that the face of the club 44 engages with the rotating bristles 39. Such an arrangement allows easy cleaning of the face of the club 44 while walking with the buggy, simply by holding the club 44 with one hand in the appropriate position. As the golf club cleaning device 10 is located close to the ground, by holding the club 44 on the correct side of the golf club cleaning device 10, any debris released from the club 44 will fall directly to the ground.

Figure 10:
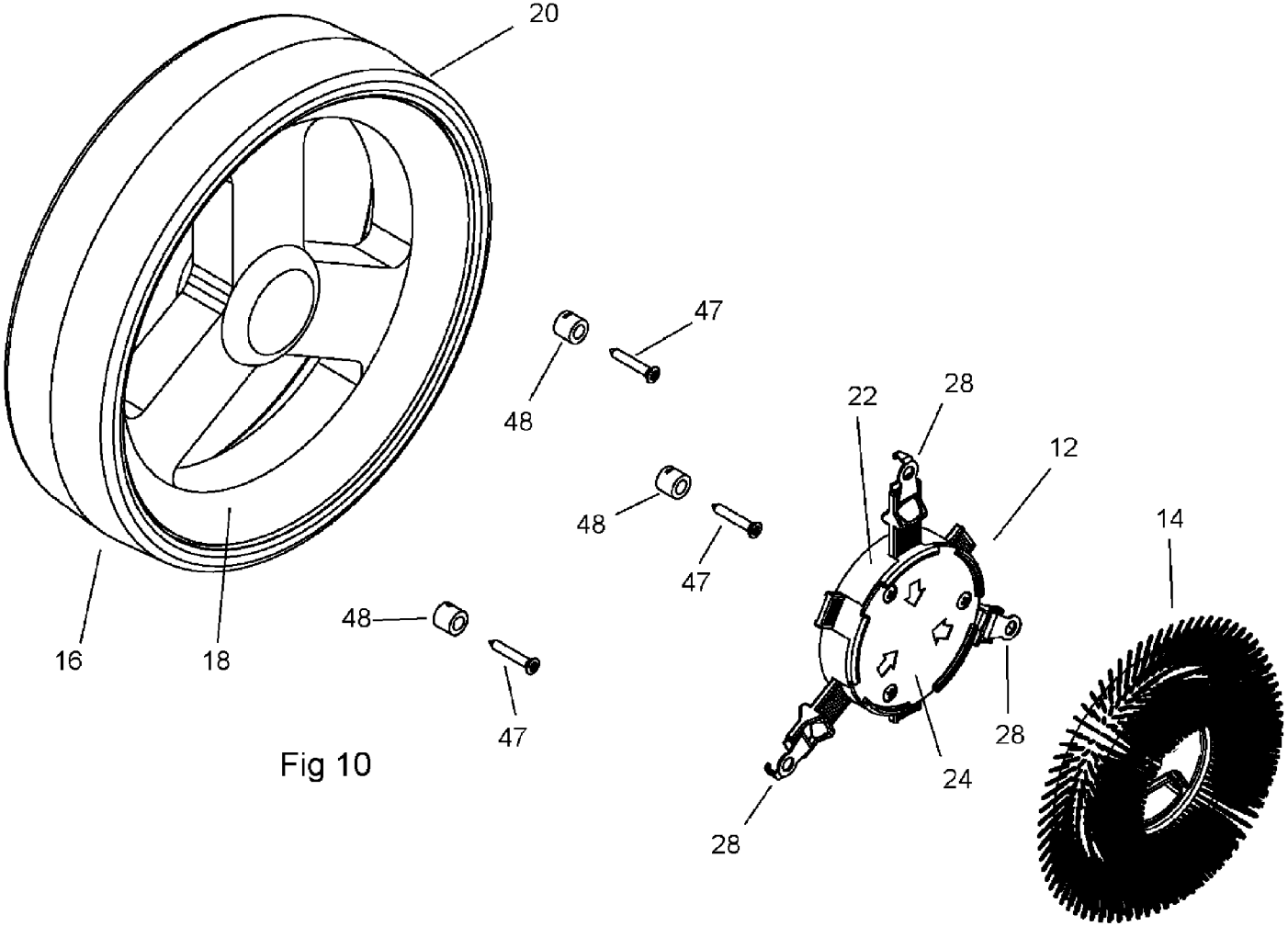
FIG. 10 is an exploded view of the golf club cleaning device showing an alternate method of attachment to a wheel.
Figure 11C:
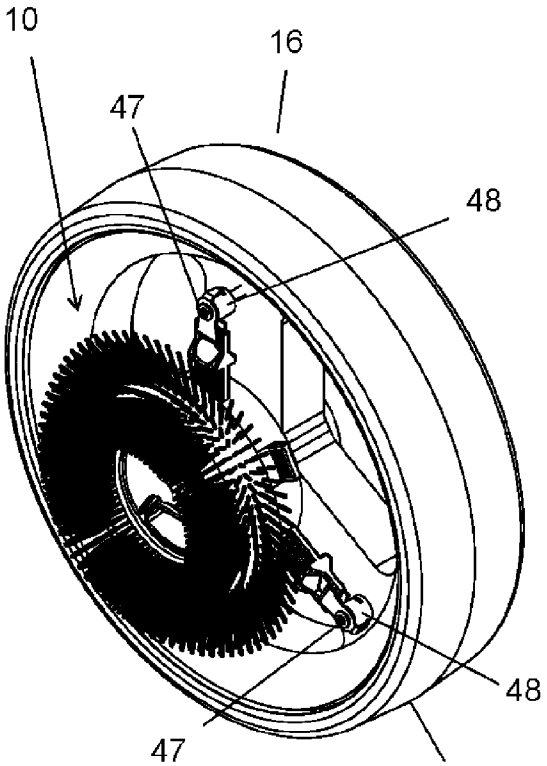
FIG. 11*c* is an upper perspective view of the golf club cleaning device secured to the wheel by the method of FIG. 10.
Figure 11B:
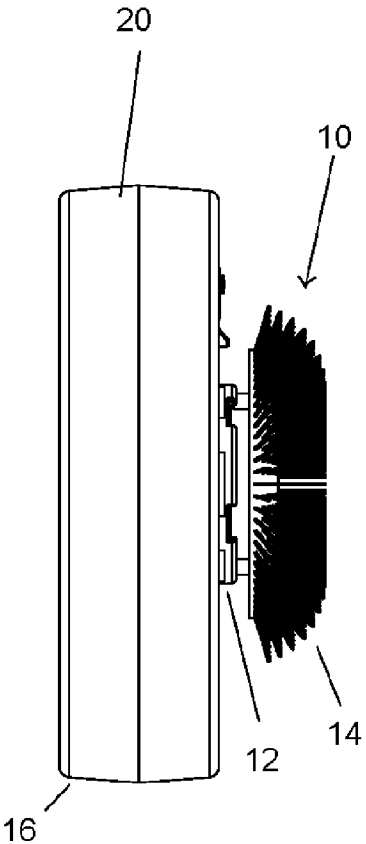
FIG. 11*b* is a side view of the golf club cleaning device secured to the wheel by the method of FIG. 10.
Figure 11A:
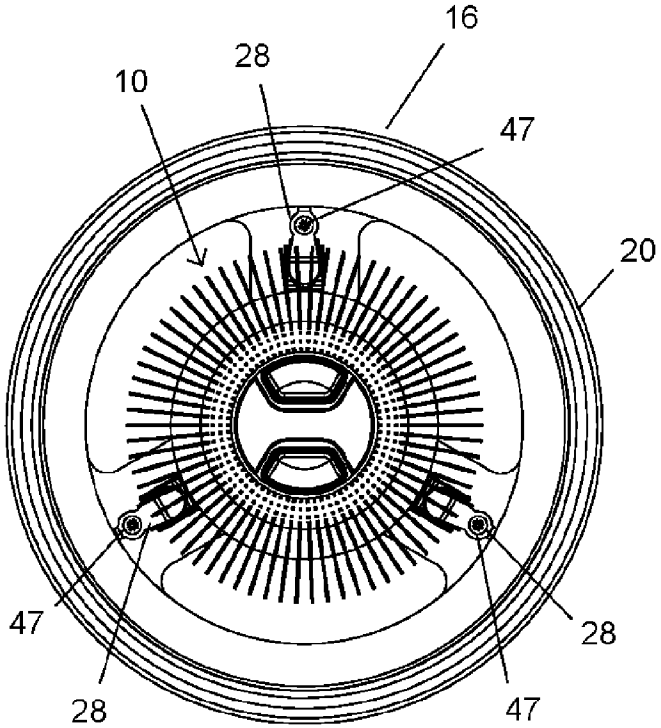
FIG. 11*a* is a front view of the golf club cleaning device secured to the wheel by the method of FIG. 10.

FIGS. 10 to 12 show an alternative method of fixing the golf club cleaning device 10 to the wheel 16 of the buggy. This method may be used, for example, when the rim 18 of the wheel does not have an edge suitable for engagement with the hooks 28. The hooks 28 are also provided with holes 46 therein for receiving a suitable fastener such as threaded fasteners 47. The threaded fasteners 47 are received through the holes 46 and screwed into the side surface of the rim 18 by pre-drilling suitable sized holes in the rim 18 at appropriate locations. Spacers 48 may also be provided between the hooks 28 and the rim 18 through which the threaded fasteners 46 are received.

In a further embodiment (not shown), the brush member 14 may be connected to the base member 12 such that the brush member 14 may rotate relative to the base member 12 under the action of a drive motor. The drive motor may be activated by appropriate control means. In this embodiment, the drive motor may be activated to cause rotation of the brush member 14 when the wheel 16 is stationary. In this way, the golf club cleaning device 10 may still be used when the buggy is not moving.

Figure 13B:
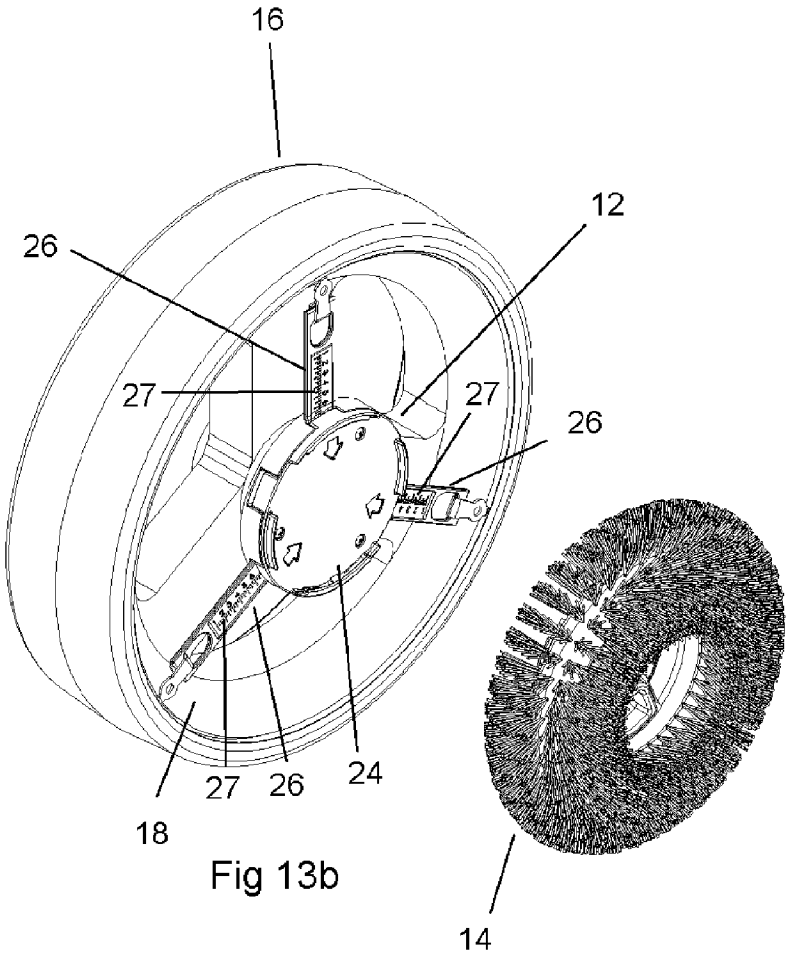
FIG. 13*b* is an upper perspective view of the golf club cleaning device of FIG. 13*a* prior to attachment of the brush member to the base member.
Figure 13A:
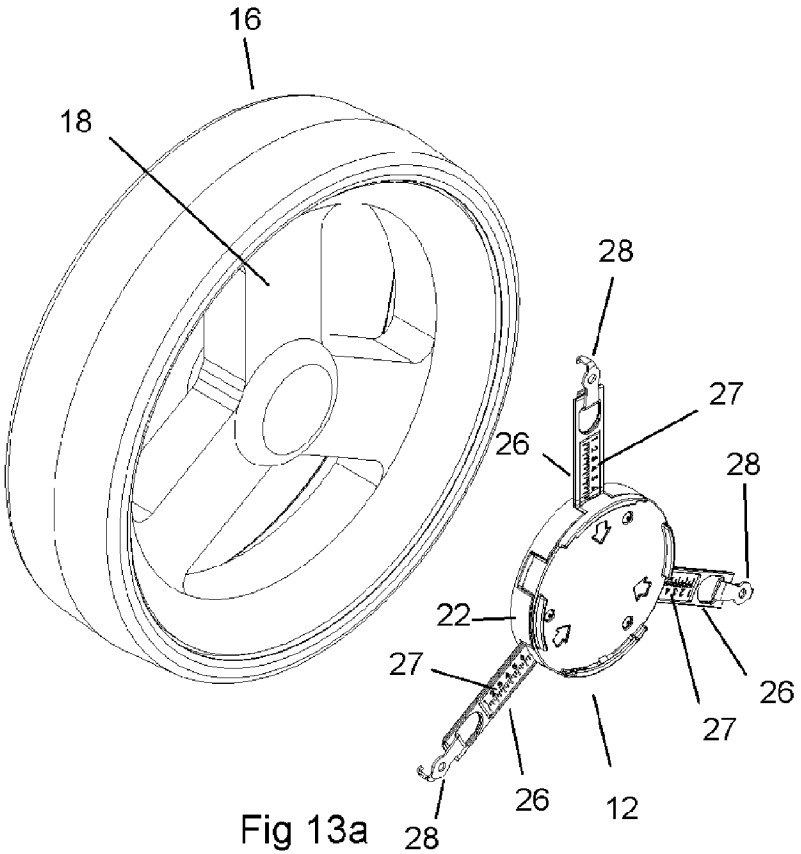
FIG. 13*a* is an upper perspective view showing the base member of a second embodiment of the invention prior to engagement with the wheel of a golf buggy.
Figure 14:
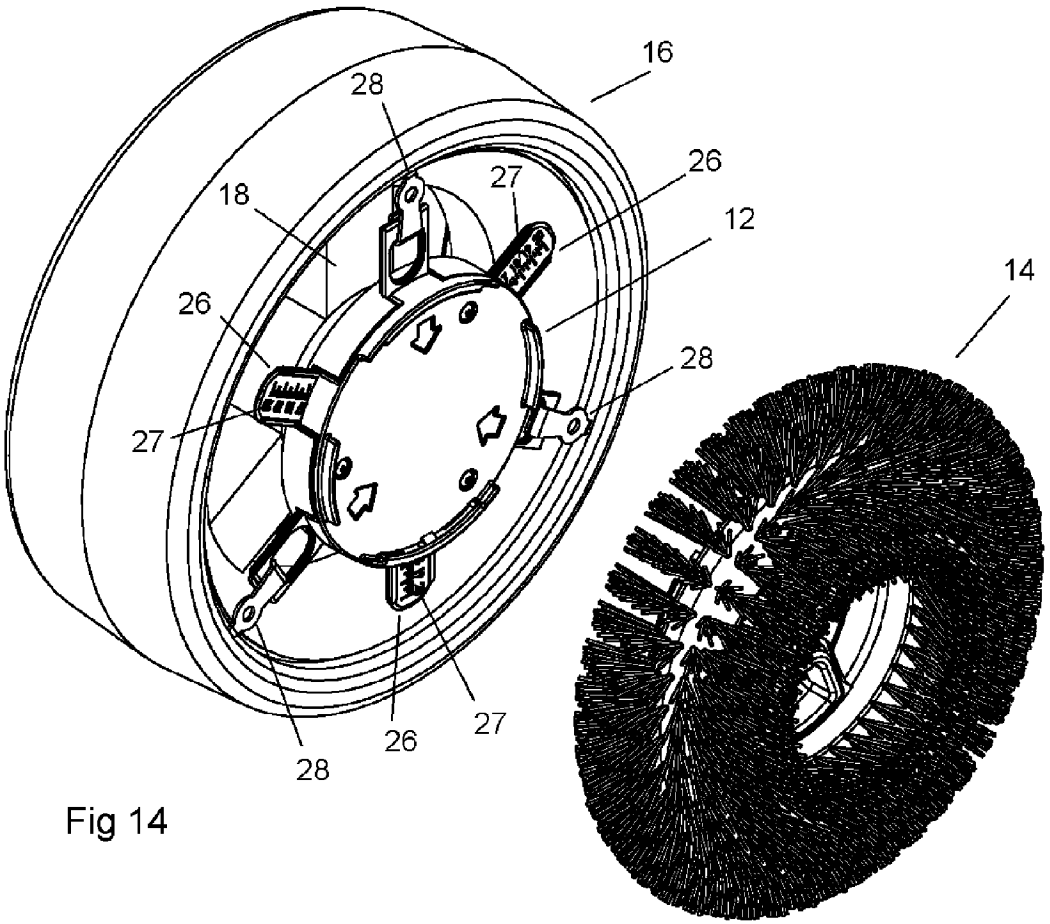
FIG. 14 is an upper perspective view of the golf club cleaning device of FIG. 13 with the base member attached to a smaller wheel.

FIGS. 13 and 14 show a second embodiment of a golf club cleaning device 10 in accordance with the present invention. The golf club cleaning device 10 is similar to the embodiment of FIGS. 1 to 12 and like reference numerals are used to denote like parts.

The golf club cleaning device 10 of FIGS. 13 and 14 includes graduations 27 on the straps 26. The graduations 27 can be used to provide an indication of the amount by which the strap 26 is extended from the base member 12. The graduations 27 can therefore be used to ensure the straps 26 are all adjusted equally so the golf club cleaning device 10 is positioned centrally with respect to the wheel 16.

Also, in this embodiment the bristles 39 are provided with a different shape around the outer edge. The bristles 39 are shaped to provide a generally annular shaped brushing surface around the periphery thereof.

It will be readily apparent to persons skilled in the relevant arts that various modifications and improvements may be made to the foregoing embodiments, in addition to those already described, without departing from the basic inventive concepts of the present invention.

The invention claimed is:

1. A golf club cleaning device comprising:

a base member;

a brush member secured to the base member having bristles arranged around a circular outer edge thereof; and one or more securing members extending from the base member, the securing members comprising straps having hooks at first ends thereof and second ends secured to the base member;

wherein the hooks engage with a peripheral edge of a rim of a wheel to secure the base member to a side surface of the wheel such that while the wheel is turning, the brush member and the base member rotate so that a face of a golf club can be cleaned by the rotating bristles.

2. A golf club cleaning device in accordance with claim 1, wherein the straps are length adjustable relative to the base member such that the hooks can be engaged with the rim and then the straps shortened to tighten the straps and secure the base member firmly relative to the rim.

3. A golf club cleaning device in accordance with claim 2, wherein the base member comprises:

a base portion arranged such that a first side surface thereof is adjacent the rim of the wheel; and a cover securable to a second opposite side surface of the base portion;

wherein second ends of the strap are received between the base portion and the cover.

4. A golf club cleaning device in accordance with claim 3, wherein the second ends of the straps are received in slots in the second side surface of the base portion.

5. A golf club cleaning device in accordance with claim 4, wherein flexible tabs are provided on lower surfaces of the slots and teeth are provided on a side of each of the straps such that tabs engage with the teeth to prevent outward movement of the straps relative to the base member but allow inward movement of the straps relative to the base member.

6. A golf club cleaning device in accordance with claim 5, wherein each of the slots is provided at a different depth so that each of the straps can be placed in the slots and pass above or below the other straps.

7. A golf club cleaning device in accordance with any claim 3, wherein the base portion is generally cylindrical in shape and the cover comprises is circular and of the same diameter as the base portion.

8. A golf club cleaning device in accordance with claim 1, wherein the straps include graduations to provide an indication of the amount by which the strap is extended from the base member.

9. A golf club cleaning device in accordance with claim 1, wherein the straps extend radially outward from the base member at equal angular spacings.

10. A golf club cleaning device in accordance claim 1, wherein the brush member is removably securable to the base member.

11. A golf club cleaning device in accordance with claim 10, wherein the brush member comprises a central disc portion and an outer rim portion, the outer rim portion being generally annular in shape and including outwardly extending bristles on the surface thereof.

12. A golf club cleaning device in accordance with claim 11, wherein the brush member includes a pair of spring biased engagement members on opposite sides of the central disc portion being mounted for slidable movement relative to the brush member such that outer edges of the engagement members are engageable with lip portions provided around the periphery of the cover to secure the brush member to the cover.

13. A golf club cleaning device in accordance with claim 10, wherein the engagement members are pushed radially inward against the spring bias and then released when the brush member is in position to move outwardly such that the outer edges thereof engage under the lip portions to secure the brush member.

14. A golf club cleaning device in accordance with claim 1, wherein the hooks are also provided with holes for receiving threaded fasteners to provide an alternative method of securing the straps to the rim of the wheel.

15. A golf club cleaning device in accordance with claim 14, wherein spacers are provided between the hooks and the rim through which the threaded fasteners are received.

* * * * *